US011708711B2

(12) United States Patent
Ishiguro et al.

(10) Patent No.: US 11,708,711 B2
(45) Date of Patent: Jul. 25, 2023

(54) VEHICLE DOOR LATCH DEVICE

(71) Applicant: MITSUI KINZOKU ACT CORPORATION, Kanagawa (JP)

(72) Inventors: Katsuyuki Ishiguro, Kanagawa (JP); Hirotaka Nishijima, Kanagawa (JP); Shintaro Okawa, Kanagawa (JP); Shunsuke Tamura, Kanagawa (JP)

(73) Assignee: MITSUI KINZOKU ACT CORPORATION, Kanagawa (JP)

( * ) Notice: Subject to any disclaimer, the term of this patent is extended or adjusted under 35 U.S.C. 154(b) by 896 days.

(21) Appl. No.: 16/582,983

(22) Filed: Sep. 25, 2019

(65) Prior Publication Data

US 2020/0102772 A1 Apr. 2, 2020

(30) Foreign Application Priority Data

Oct. 1, 2018 (JP) ..... 2018-187008

(51) Int. Cl.
*E05B 81/06* (2014.01)
*E05B 85/02* (2014.01)
*E05B 79/04* (2014.01)
*E05B 81/14* (2014.01)

(52) U.S. Cl.
CPC ..... *E05B 85/02* (2013.01); *E05B 79/04* (2013.01); *E05B 81/14* (2013.01); *E05Y 2900/531* (2013.01); *Y10T 292/1082* (2015.04)

(58) Field of Classification Search
CPC ..... Y10T 292/1047; Y10T 292/1082; E05B 85/02; E05B 81/14
See application file for complete search history.

(56) References Cited

U.S. PATENT DOCUMENTS 4,538,845 A * 9/1985 Yamada ..... E05B 79/08 292/216
4,624,491 A * 11/1986 Vincent ..... E05B 81/34 292/216
4,932,690 A * 6/1990 Kleefeldt ..... E05B 81/16 292/201
5,697,236 A * 12/1997 Kleefeldt ..... E05B 79/20 292/201
6,076,868 A * 6/2000 Roger, Jr. ..... E05B 81/14 292/216
6,338,508 B1 * 1/2002 Kleefeldt ..... E05B 81/14 292/216

(Continued)

FOREIGN PATENT DOCUMENTS

DE 19614123 A1 * 10/1997 ..... E05B 81/14
DE 19650826 A1 * 6/1998 ..... E05B 81/14

(Continued)

*Primary Examiner* — Carlos Lugo
(74) *Attorney, Agent, or Firm* — McDermott Will & Emery LLP

(57) ABSTRACT

A vehicle door latch device includes: a latch body including: a latch secured by a latch shaft on a rear surface side of the latch body, the latch being configured to engage with a striker; a ratchet secured by a ratchet shaft on the rear surface side of the latch body, the ratchet being configured to engage with the latch; and a striker advancing path into which the striker advances relatively; a motor configured to release the ratchet from the latch; and an actuator case provided continuously on top of the latch body, the actuator case being configured to accommodate the motor.

4 Claims, 14 Drawing Sheets

(56) References Cited

U.S. PATENT DOCUMENTS

| | | | | |
|---|---|---|---|---|
| 6,371,537 | B1 * | 4/2002 | Vige | E05B 81/14 292/201 |
| 6,386,599 | B1 * | 5/2002 | Chevalier | E05B 77/28 292/201 |
| 6,428,058 | B1 * | 8/2002 | Graute | E05B 85/01 292/201 |
| 6,497,436 | B1 * | 12/2002 | DeBlock | E05B 81/06 292/201 |
| 7,500,700 | B2 * | 3/2009 | Kunst | E05B 85/02 292/216 |
| 8,403,379 | B2 * | 3/2013 | Ishiguro | E05B 81/06 292/216 |
| 9,551,172 | B2 | 1/2017 | Barmscheidt et al. | |
| 9,810,004 | B2 * | 11/2017 | Scholz | E05B 81/20 |
| 2001/0050483 | A1 * | 12/2001 | Hanisch | E05B 81/16 292/216 |
| 2002/0167177 | A1 * | 11/2002 | Erices | E05B 85/02 292/201 |
| 2012/0175896 | A1 * | 7/2012 | Martinez | E05B 81/34 292/199 |

FOREIGN PATENT DOCUMENTS

| | | | | | |
|---|---|---|---|---|---|
| DE | 19955882 | C2 | * | 10/2003 | E05B 85/01 |
| DE | 10300721 | A1 | * | 7/2004 | E05B 81/14 |
| EP | 159238 | A | * | 10/1985 | E05B 81/14 |
| FR | 2554898 | A | * | 5/1985 | E05B 81/14 |
| FR | 2775717 | A1 | * | 9/1999 | E05B 79/12 |
| GB | 2433768 | A | * | 7/2007 | E05B 81/14 |
| JP | H02-030868 | A | | 2/1990 | |
| JP | 2000-027514 | A | | 1/2000 | |
| JP | 2001-262903 | A | | 9/2001 | |
| JP | 2015-074976 | A | | 4/2015 | |
| JP | 6213927 | B2 | | 10/2017 | |

* cited by examiner

VEHICLE DOOR LATCH DEVICE

The present application claims priority to and incorporates by reference the entire contents of Japanese Patent Application No. 2018-187008 filed in Japan on Oct. 1, 2018.

BACKGROUND

The present disclosure relates to a vehicle door latch device.

A known vehicle door latch device has a latch unit engaged with a striker. The latch unit is fixed to a door panel of a vehicle door, and the striker is fixed to a door post of a vehicle.

The door panel is a metal panel having a surface in a door width direction. The latch unit is fixed usually by three countersunk bolts such that its rear surface side is in surface contact with the door panel.

A guide rail for a window is disposed on the front surface side of the latch unit. Japanese Laid-open Patent Publication No. 2000-027514 and Japanese Laid-open Patent Publication No. 02-030868 disclose a relation between the latch unit, the door panel, and the guide rail, in which the lateral center of the latch unit is attached in an attachment space confined between the door panel and the guide rail.

Since the upper side of the guide rail is inclined so as to approach the plane of the door panel, the front-back distance on the upper side of the attachment space is narrow, whereas the front-back distance on the lower side is slightly wide. With this situation, the latch unit in Japanese Laid-open Patent Publication No. 2000-027514 and Japanese Laid-open Patent Publication No. 02-030868 is formed in an inclined shape to be adapted to the attachment space, and the motor actuator attached to the latch unit is also disposed on the lower side of the latch unit with enough space.

Japanese Laid-open Patent Publication No. 2001-262903 discloses a vehicle door latch device including a motor actuator relocated from the lower side to the lateral side of a latch unit formed in an L shape. In the L-shaped latch unit, the actuator does not overlap the guide rail in the front-back direction and therefore the thickness of the actuator does not interfere with the guide rail.

Japanese Patent No. 6213927 (U.S. Pat. No. 9,551,172) discloses a vehicle door latch device in which a single actuator (motor) enables actuation of power release means and actuation of power lock means. There is no disclosure as to the place where the actuator is arranged.

Japanese Laid-open Patent Publication No. 2015-074976 discloses a vehicle door latch device including a latch, a ratchet (release component force-disengaging ratchet) that can be engaged with the latch, and a ratchet retainer that blocks movement of the ratchet in a latch disengaging direction. There is no disclosure about an actuator.

In the related art, the actuator is provided to be continuous with the lower part of the latch unit (Japanese Laid-open Patent Publication No. 2000-027514, Japanese Laid-open Patent Publication No. 02-030868) or provided to be continuous with the side of the latch unit (Japanese Laid-open Patent Publication No. 2001-262903).

When the actuator is used as power release means for disengaging the latch from the ratchet, the ratchet to be displaced by output of the actuator is disposed in the vicinity of the actuator, and the latch is spaced apart from the actuator.

In this case, the ratchet moves downward whereby the ratchet is disengaged from the latch, so a ratchet spring that allows the ratchet to engage with the latch moves the ratchet up and down. In such an arrangement relation, if the ratchet spring malfunctions or if unexpected rotation resistance occurs in the ratchet, the latchet may be unable to return to the position where it can engage with the latch, resulting in a failure to close the door.

In the configuration in which the actuator is relocated to the side of the latch unit (Japanese Laid-open Patent Publication No. 2001-262903), the structure is complicated, increased in size, and expensive.

SUMMARY

In some embodiments, a vehicle door latch device includes: a latch body including: a latch secured by a latch shaft on a rear surface side of the latch body, the latch being configured to engage with a striker; a ratchet secured by a ratchet shaft on the rear surface side of the latch body, the ratchet being configured to engage with the latch; and a striker advancing path into which the striker advances relatively; a motor configured to release the ratchet from the latch; and an actuator case provided continuously on top of the latch body, the actuator case being configured to accommodate the motor.

In some embodiments, a vehicle door latch device includes: a latch body including: a striker advancing path into which a striker advances relatively; a latch secured to the latch body by a latch shaft at a position below the striker advancing path, the latch being configured to engage with the striker; and a ratchet secured to the latch body by a ratchet shaft at a position above the striker advancing path, the ratchet being configured to engage with the latch; and an actuator provided on top of the latch body, the actuator being configured to release the ratchet from the latch.

In some embodiments, a vehicle door latch device includes: a latch body including: a striker advancing path into which a striker advances relatively; a latch secured to the latch body by a latch shaft at a position below the striker advancing path, the latch being configured to engage with the striker; a release component force-disengaging ratchet secured at a lateral center of the latch body by a ratchet shaft at a position above the striker advancing path, the ratchet being configured to engage with the latch; and a ratchet retainer secured by a support shaft at a position above the striker advancing path and at the latch body on a side in an advancing direction of the striker, the ratchet retainer being configured to block movement of the ratchet in a latch disengaging direction by a release component force of the ratchet; and a cover plate provided on a rear surface side of the latch body, the cover plate including bosses into which countersunk bolts used for fixing the vehicle door latch device to a door panel are inserted, where one of the bosses faces a space in the latch body formed on an opposite side to the support shaft with the ratchet shaft interposed therebetween.

The above and other objects, features, advantages and technical and industrial significance of this disclosure will be better understood by reading the following detailed description of presently preferred embodiments of the disclosure, when considered in connection with the accompanying drawings.

DETAILED DESCRIPTION

Figure 1:
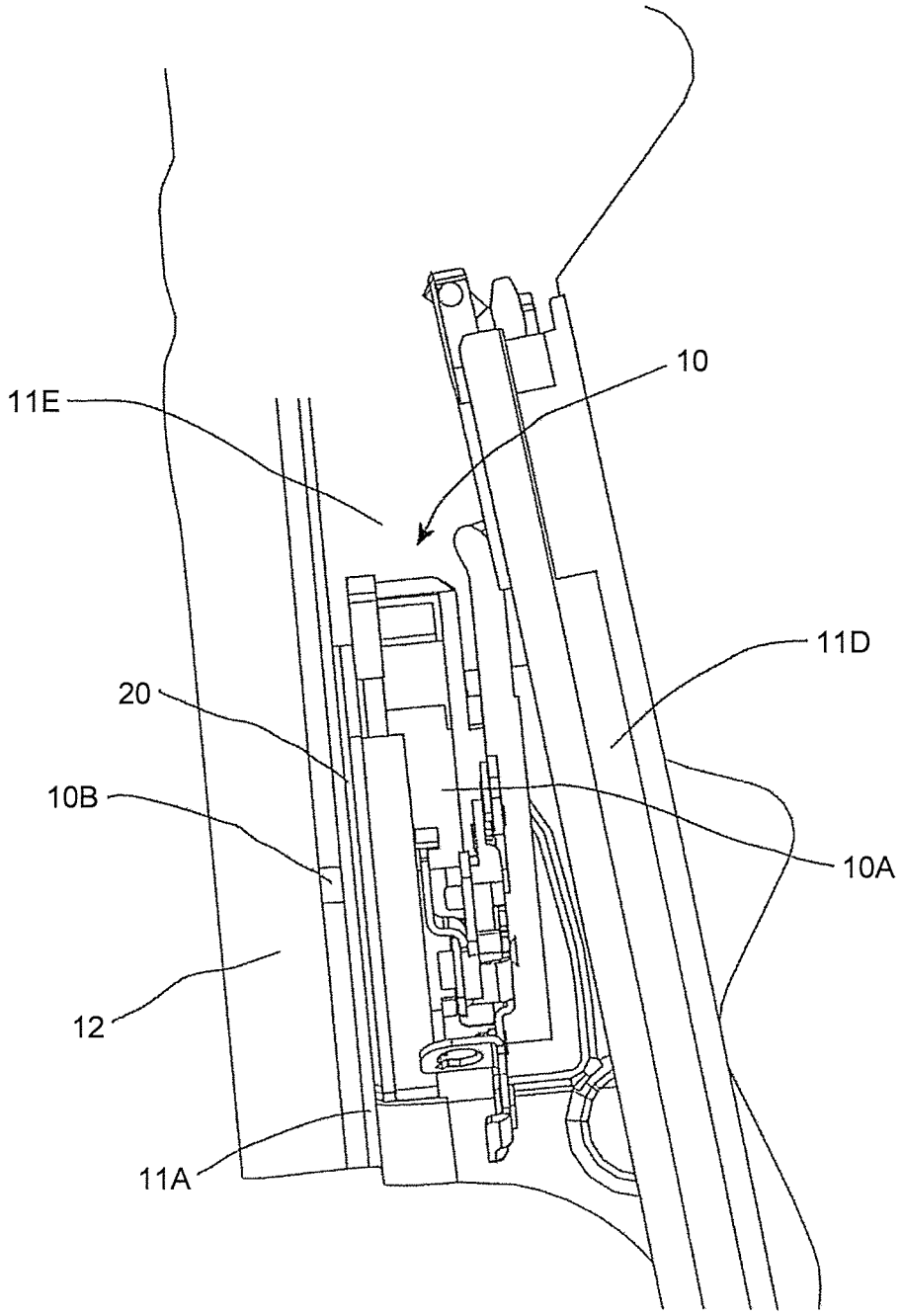
FIG. 1 is a partial longitudinal cross-sectional side view illustrating the attachment relation between a vehicle door latch device according to the present disclosure and a vehicle door.

Embodiments for carrying out the present disclosure will be described with reference to the drawings. As illustrated in FIG. 1, a vehicle door latch device 10 according to the present disclosure includes a latch unit 10A and a striker 10B. The latch unit 10A is fixed to a door panel 11A of a vehicle door, and the striker 10B is fixed to a door post 12 of a vehicle body. A door-opening handle 11B (FIG. 7) and a door key cylinder 11C (FIG. 7) of the vehicle door are coupled to the latch unit 10A by physical coupling means or electrical coupling means.

The door panel 11A is a metal panel having a surface in the door width direction. The latch unit 10A is fixed usually by three countersunk bolts 13 (FIG. 2) such that its rear surface side is in surface contact with the door panel 11A. In the following description, the front side and the back side are defined with reference to the vehicle.

Figure 2:
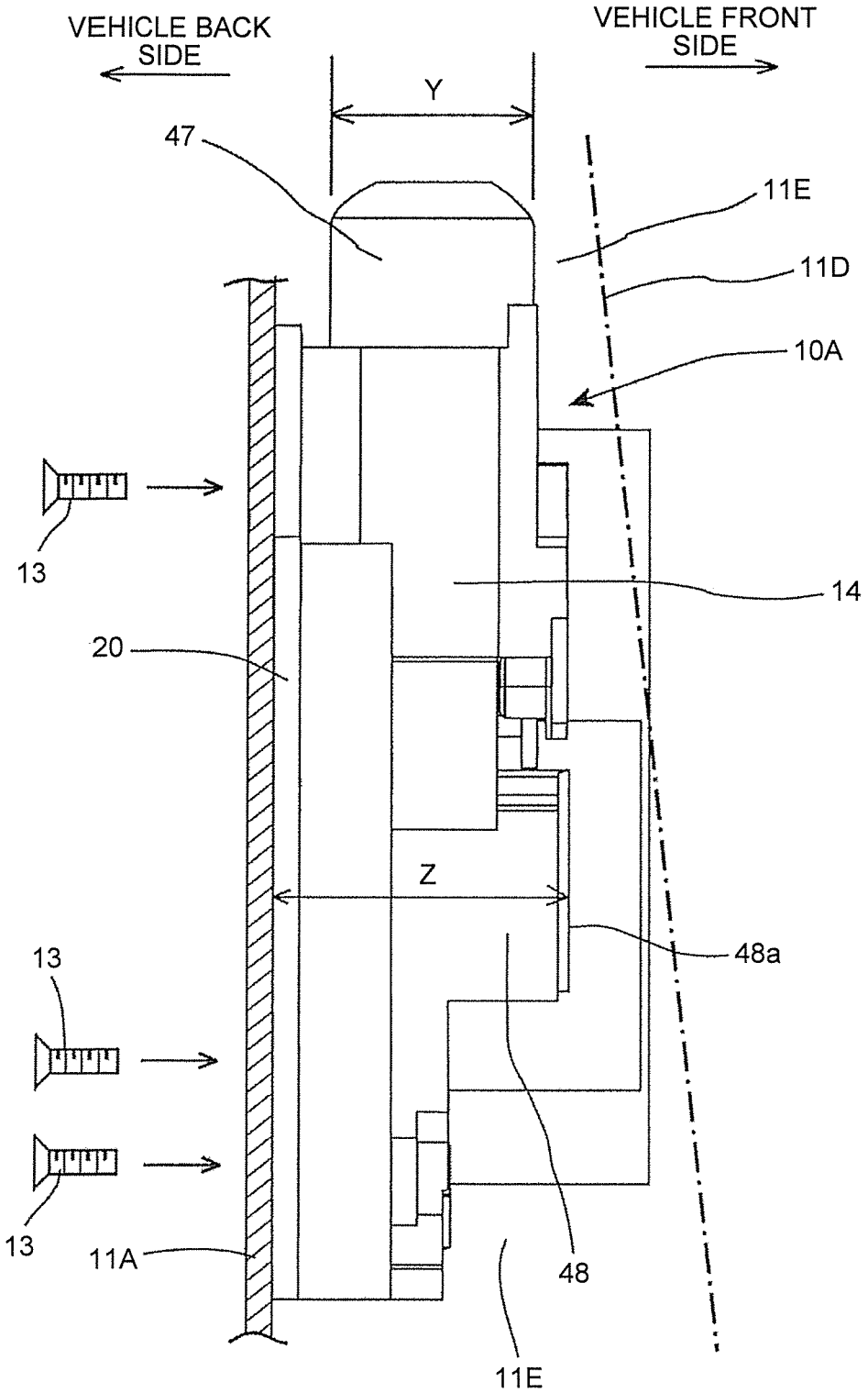
FIG. 2 is a reference side view illustrating the thickness in the front-back direction of a latch unit of the vehicle door latch device.

As illustrated in FIGS. 1 and 2, a guide rail 11D for a window (not illustrated) is provided in front of the door panel 11A so that the window moves up and down along the guide rail 11D. The guide rail 11D is positioned approximately at the center in the width direction of the door and has a positional relation such that it overlaps the lateral center of the latch unit 10A at the front and the back as illustrated in FIG. 3.

Since the distance between the door panel 11A and the guide rail 11D is narrow, there is a limitation in thickness in the front-back direction at the center in the lateral direction of the latch unit 10A. Specifically, as illustrated in FIG. 1, since the upper side of the guide rail 11D is inclined so as to approach the plane of the door panel 11A, severe limitation is required in particular for the thickness in the front-back direction at the upper center side of the latch unit 10A. An attachment space 11E defined between the door panel 11A and the guide rail 11D accommodates the lateral center of the latch unit 10A.

Figure 3:
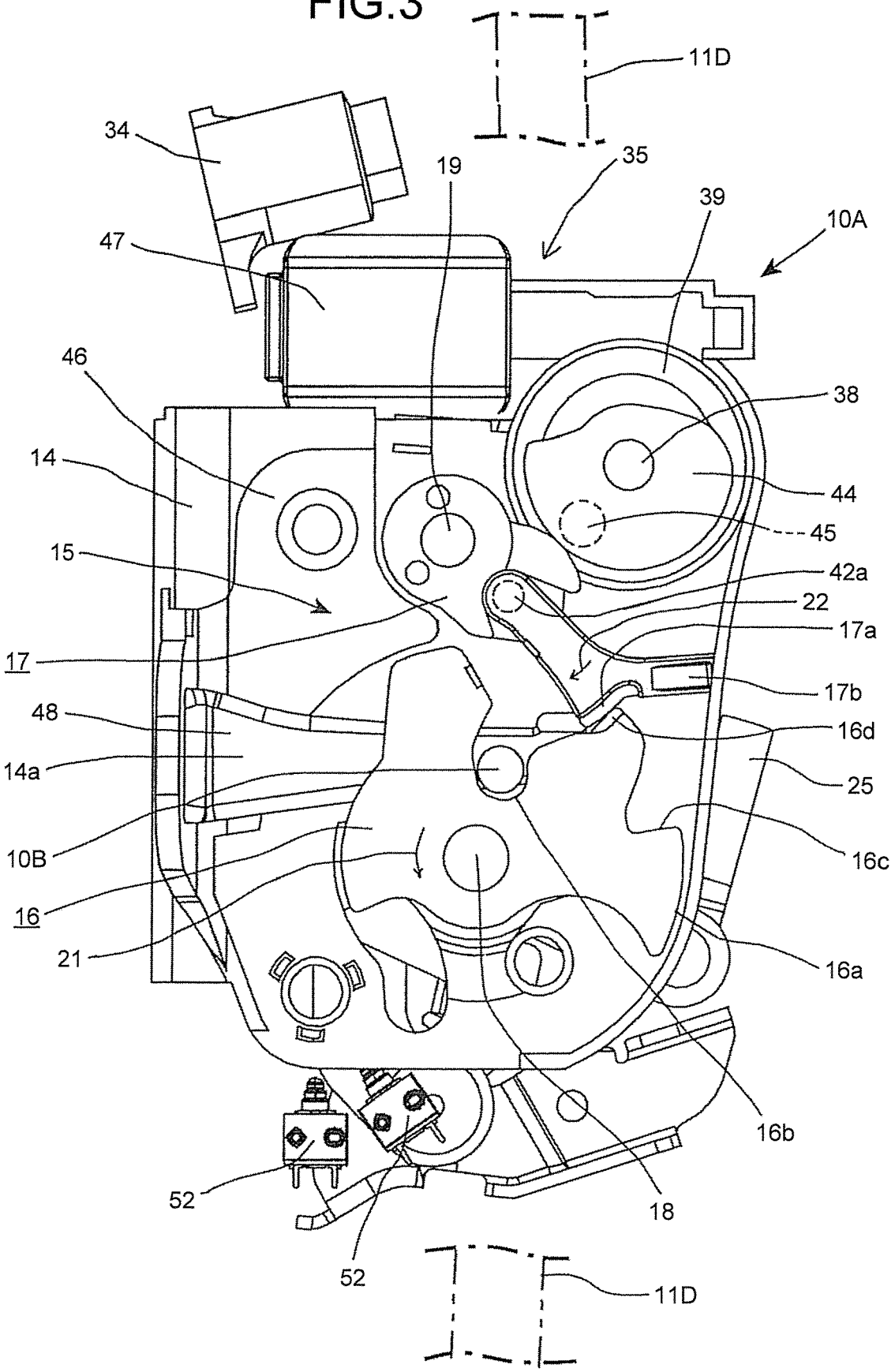
FIG. 3 is a rear view of the latch unit with a cover plate removed in a full latch state.

FIG. 3 illustrates the rear surface of the latch unit 10A in the door-closed state, in which a latch mechanism 15 is provided on a latch body 14 of the latch unit 10A. The latch mechanism 15 includes a latch 16 to be engaged with the striker 10B to rotate in a latch direction (clockwise) and a ratchet 17 engaged with the latch 16. The latch 16 is secured by a latch shaft 18, and the ratchet 17 is secured by a ratchet shaft 19. A flat plate-shaped cover plate 20 (FIG. 23) is attached to cover the rear surface of the latch body 14.

The latch 16 is biased by a latch spring 21 (illustrated by an arrow depicting the elastic force direction) in a door-opening direction (unlatch direction/counterclockwise). The ratchet 17 is biased by a ratchet spring 22 (illustrated by an arrow depicting the elastic force direction) in a latch engagement direction. In the unlatch state in FIG. 4, a pawl 17*a* of the ratchet 17 abuts on an outer periphery 16*a* of the latch 16 under the elastic force of the ratchet spring 22.

When the vehicle door moves in the door-closing direction, the striker 10B fixed to the vehicle body (door post 12) relatively advances into a striker advancing path 14*a* in the horizontal direction formed in the latch body 14 and then comes into abutment with a U-shaped striker engagement groove 16*b* of the latch 16 to rotate the latch 16 in a full latch direction against the elastic force of the latch spring 21. On the outer periphery of the latch 16, a half latch engagement portion 16*c* and a full latch engagement portion 16*d* configured to be engaged with the pawl 17*a* of the ratchet 17 are disposed side by side in a well-known manner.

In normal door-closing operation, the latch 16 rotates from the unlatch position (FIG. 4) to the excessive rotating position beyond the half latch position and the full latch position. The latch 16, having rotated to the excessive rotating position, is returned in the unlatch direction by the repulsive force of the latch spring 21 and the repulsive force of a seal member (not illustrated) provided between the door and the vehicle body (hereinafter these forces are collectively referred to as "latch return force").

When the latch 16 is returned from the excessive rotating position by the latch return force, the full latch engagement portion 16*d* comes into abutment and engages with the pawl 17*a* of the ratchet 17 displaced from the latch release position to the latch engagement position by the elastic force of the ratchet spring 22 and reaches a full latch state (FIG. 5), whereby the door closing is completed.

A ratchet pin 17*b* protruding toward the front surface of the latch body 14 is provided at the front end of the ratchet 17.

Figure 7:
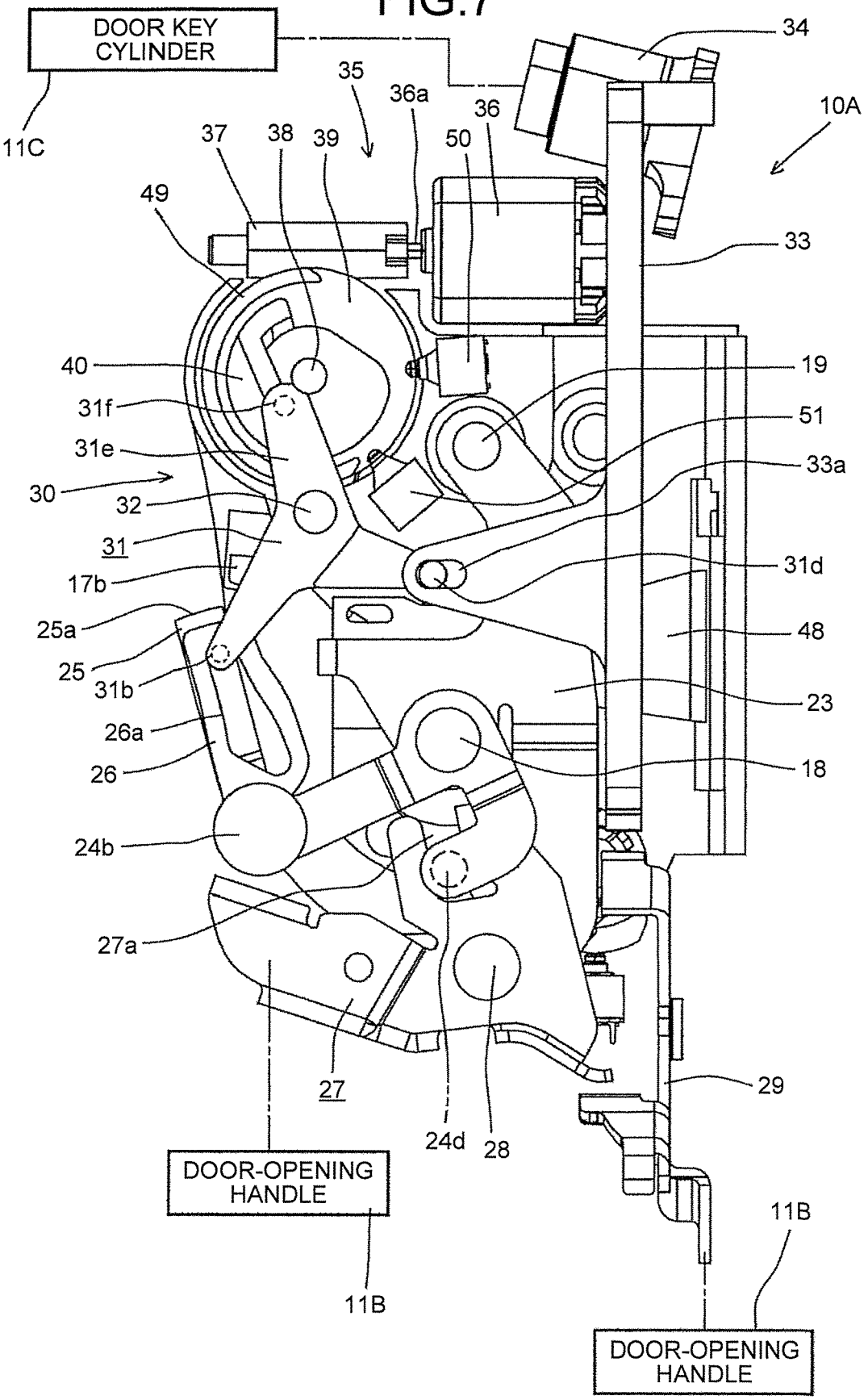
FIG. 7 is a rear view of the latch unit in a locked state and the guide rail denoted by a phantom line.
Figure 8:
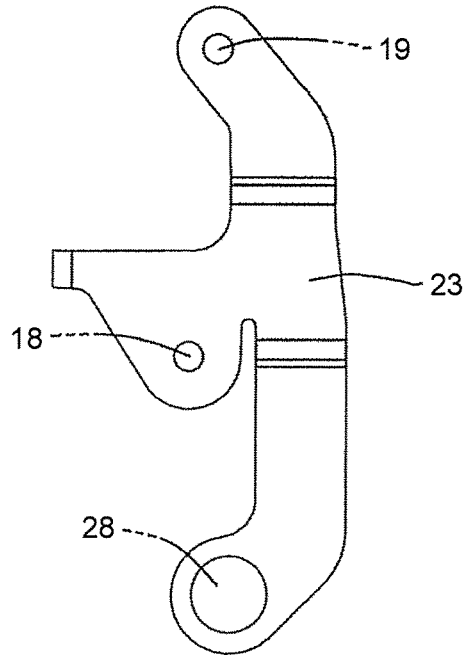
FIG. 8 is a front view of a sub plate of the latch unit.

As illustrated in FIG. 7, a sub plate 23 (FIG. 8) is provided on the front surface of the latch unit 10A. The sub plate 23 and the cover plate 20 are fixed without looseness by the latch shaft 18 and the ratchet shaft 19 with the latch body 14 interposed therebetween.

Figure 9:
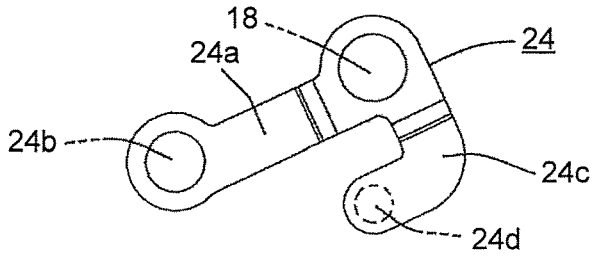
FIG. 9 is a front view of an open lever of the latch unit.

An open lever 24 (FIG. 9) is secured by the latch shaft 18 on the front surface of the latch unit 10A. An open link 25 and a sub link 26 are secured by a pin 24*b* to a first arm 24*a* extending on the side of the open lever 24. In an embodiment, the open link 25 and the sub link 26 are disposed so as to overlap at the front and the back and rotate about the pin 24*b* in an interlocking manner. The sub link 26 has an elongated engagement slot 26*a*.

Figure 10:
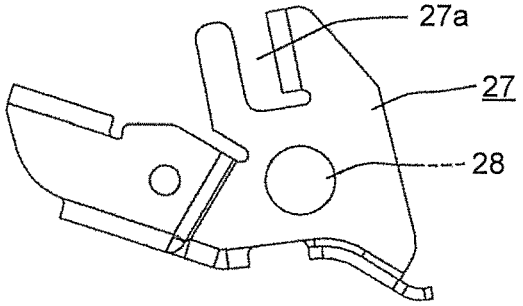
FIG. 10 is a front view of an outer lever of the latch unit.

An outer lever 27 (FIG. 10) is provided below the open lever 24. The outer lever 27 is secured to the sub plate 23 by a pin 28. A second arm 24*c* extending downward from the open lever 24 is joined to a slit 27*a* in the outer lever 27 by a joint pin 24*d*.

The outer lever 27 is joined to the door-opening handle 11B (preferably, outside door-opening handle). With the door opening operation of the door-opening handle 11B, the outer lever 27 makes a door-opening rotation (counterclockwise rotation) in FIG. 7 and the open lever 24 makes an open rotation (clockwise rotation) through the joint pin 24*d*.

An inner lever 29 is provided on the side of the outer lever 27. The inner lever 29 is joined to the door-opening handle 11B (preferably, inside door-opening handle). With the door opening operation of the inside door-opening handle, the inner lever 29 allows the outer lever 27 to make an open rotation (counterclockwise rotation).

The latch unit 10A is provided with a lock mechanism 30. The lock mechanism 30 allows the open link 25 (sub link 26) to rotate about the pin 24*b*. In FIG. 7, an abutment surface 25*a* at the tip end of the open link 25 is shifted leftward from the ratchet pin 17*b* and in a locked state. When the open link 25 rotates clockwise about the pin 24*b*, the abutment surface 25*a* confronts the ratchet pin 17*b* and switches to the unlocked state. In the unlocked state, when the door-opening rotation of the open lever 24 causes the open link 25 to move upward, the abutment surface 25*a* comes into abutment with the ratchet pin 17*b* and releases the ratchet 17 from the latch 16 to bring about a door-opening enabled state.

Figure 11:
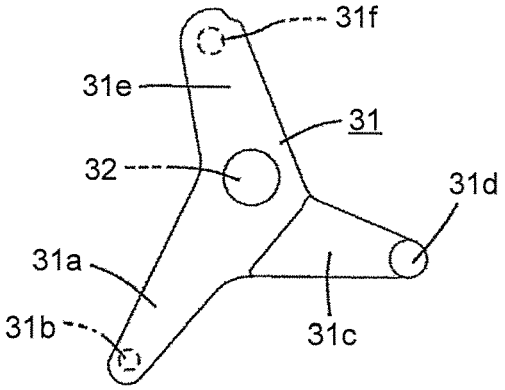
FIG. 11 is a front view of a lock lever of the latch unit.

The lock mechanism 30 has a lock lever 31 (FIG. 11) having three arms. The lock lever 31 is secured by a lock shaft 32. A first arm 31*a* of the lock lever 31 is implanted with a lock pin 31*b*. The lock pin 31*b* is slidably engaged with the engagement slot 26*a* so that the rotation of the lock lever 31 switches the open link 25 (sub link 26) between the locked position and the unlocked position.

A second arm 31*c* of the lock lever 31 is provided with a joint pin 31*d*. The joint pin 31*d* is engaged with a slot 33*a* of a lock link 33. The lock link 33 has an elongated form and preferably is joined to the door key cylinder 11C through a key lever 34. When the lock link 33 moves up and down through the operation of the door key cylinder 11C, the lock lever 31 rotates about the lock shaft 32 so that the open link 25 (sub link 26) switches between the locked position and the unlocked position.

A third arm 31*e* of the lock lever 31 is configured to be joined to a motor actuator 35 in connection therewith such that the lock lever 31 rotates by the power of the motor. The actuator 35 therefore has a function of switching the locked state and the unlocked state.

The actuator 35 includes a motor 36, a cylindrical worm 37 fixed to a motor shaft 36*a*, and a cam wheel 39 meshed with the cylindrical worm 37 to rotate about a support shaft 38. The outer peripheral surface of the cam wheel 39 serves as a gear surface.

Figure 12:
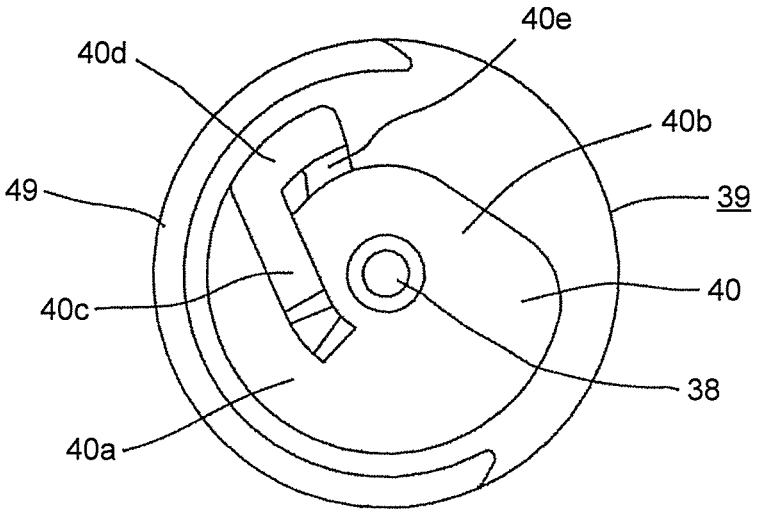
FIG. 12 is a front view of a cam wheel of the latch unit.
Figure 13:
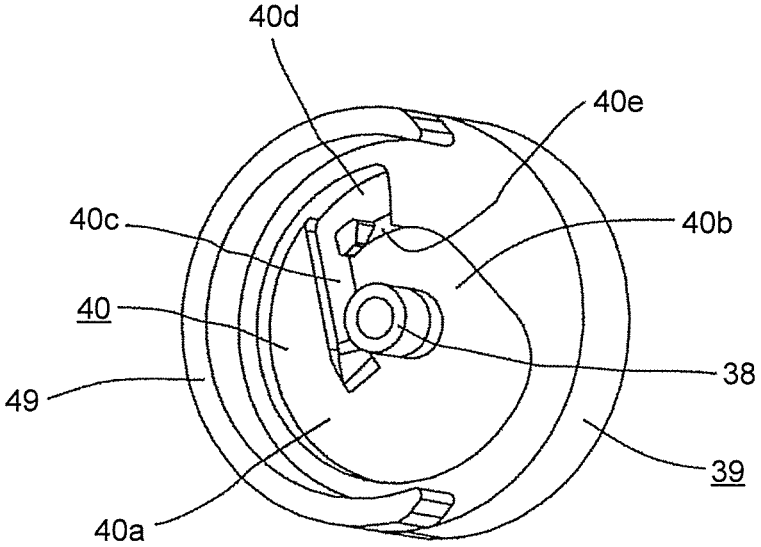
FIG. 13 is a front-side perspective view of the cam wheel of the latch unit.
Figure 14:
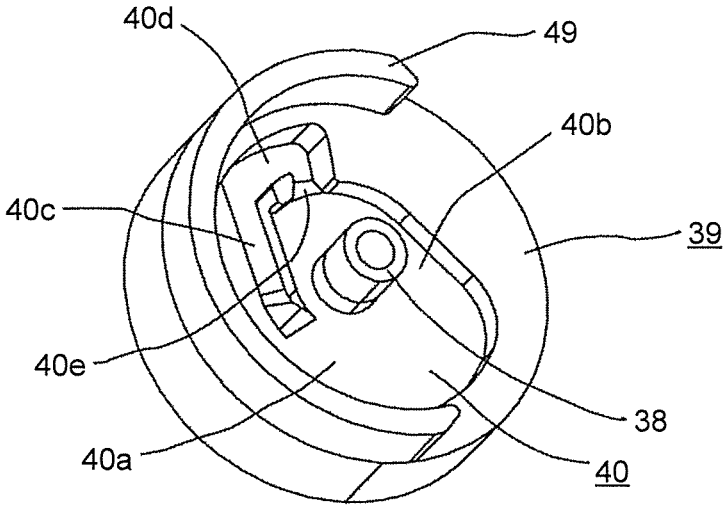
FIG. 14 is a front-side perspective view of the cam wheel of the latch unit.

The third arm 31*e* of the lock lever 31 is provided with a follower pin 31*f*. The follower pin 31*f* is slidably engaged with a cam groove 40 formed in the cam wheel 39. As illustrated in FIGS. 12 to 14, the cam groove 40 includes a wide-range flat groove 40*a* extending radially from the support shaft 38 and a narrow-range flat groove 40*b* formed on the opposite side to the wide-range flat groove 40*a* with the support shaft 38 interposed therebetween. The radial extension of the narrow-range flat groove 40*b* from the support shaft 38 is narrow but has the same groove depth as the wide-range flat groove 40*a*.

The cam groove 40 has a radial groove 40*c*. The radial groove 40*c* extends from the inner end side to the outer end side with a sweepback angle relative to the support shaft 38. The radial groove 40*c* is a groove one-level deeper than the wide-range flat groove 40*a* and the narrow-range flat groove 40*b*, and the inner end side of the radial groove 40*c* is communicatively connected to the wide-range flat groove 40*a* such that the groove becomes gradually shallow. The outer end side of the radial groove 40*c* is communicatively connected with the beginning end side of an arc groove 40*d* having the same depth.

The arc groove 40*d* and the outer periphery of the wide-range flat groove 40*a* have the same radius. The terminating end side of the arc groove 40*d* is communicatively connected to the outer side of a communicative groove 40*e* extending in the radial direction of the support shaft 38. The communicative groove 40*e* is formed so as to become gradually shallow from the outer side toward the inner side, and the inner side of the communicative groove 40*e* is communicatively connected with the narrow-range flat groove 40*b*. The follower pin 31*f* is preferably a float pin structure that can follow the level difference in the cam groove 40.

Figure 15:
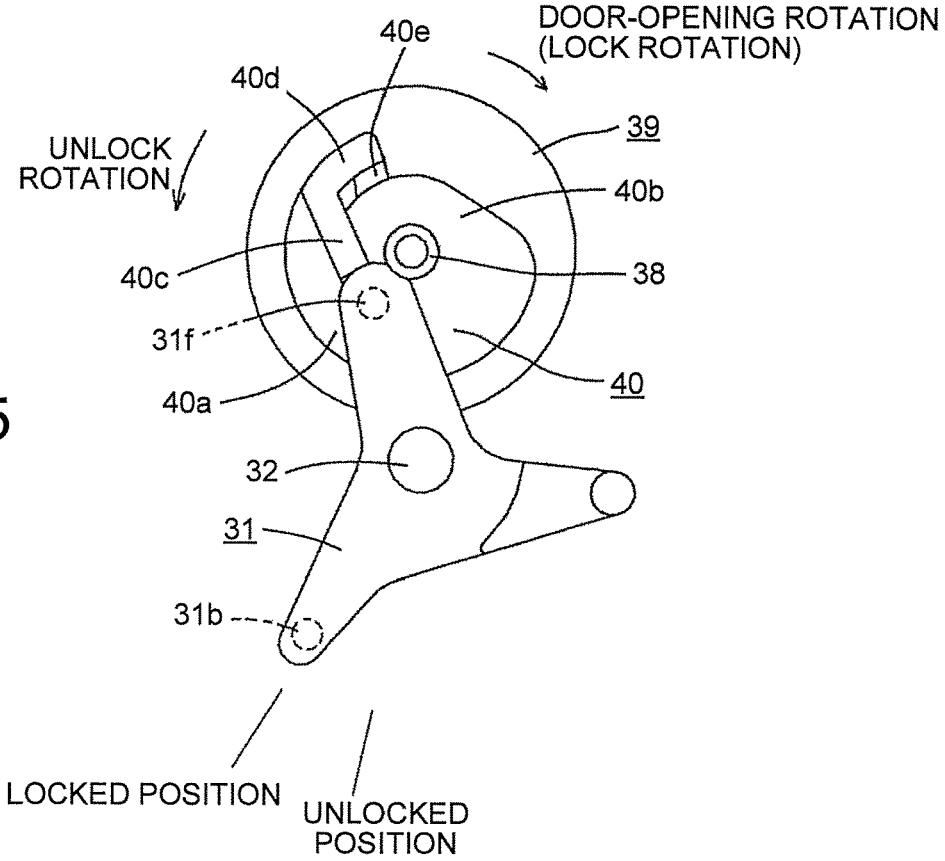
FIG. 15 is a front view of the cam wheel in a reference position and the lock lever in a locked position.

FIG. 7 and FIG. 15 illustrate a reference position of the cam wheel 39. The lock lever 31 is in the locked position. In the locked position, the follower pin 31*f* of the lock lever 31 is proximate to the support shaft 38. The follower pin 31*f* in the locked position faces the vicinity of the inner end of the radial groove 40*c* in the reference position.

Figure 16:
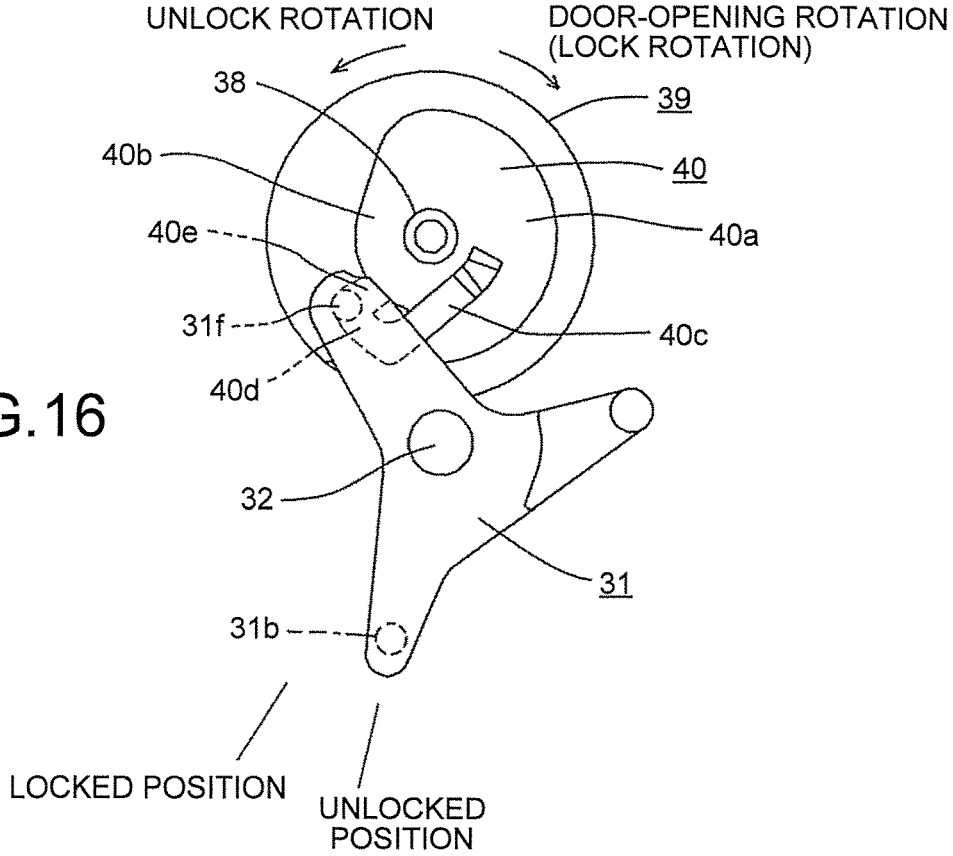
FIG. 16 is a front view of the cam wheel after unlock rotation and the lock lever in an unlocked position.

In the state in FIG. 7 and FIG. 15, when the unlocked state is set by the actuator 35, the actuator 35 allows the cam wheel 39 to rotate counterclockwise from the reference position. Then, the follower pin 31*f* of the lock lever 31 advances relatively from the wide-range flat groove 40*a* into the radial groove 40*c* and the arc groove 40*d*. The follower pin 31*f* thus moves apart from the support shaft 38, and the lock lever 31 rotates counterclockwise. As illustrated in FIG. 16, the lock lever 31 moves to the unlocked position, and the open link 25 (sub link 26) also switches to the unlocked position. In the state in FIG. 16, the actuator 35 can allow the cam wheel 39 to rotate clockwise and return to the reference position and then return to the locked state.

In the state in FIG. 7 and FIG. 15, when the unlocked state is set manually, the door key cylinder 11C is operated to move the lock link 33 upward to rotate the lock lever 31 counterclockwise. Here, since the follower pin 31*f* only moves from the inside to the outside in the wide-range flat groove 40*a* with no resistance, the switching to the unlocked position of the open link 25 (sub link 26) can be smoothly performed. When the cam wheel 39 is in the reference position, the return from the unlocked position to the locked position can be performed similarly through the operation of the door key cylinder 11C.

Figure 17:
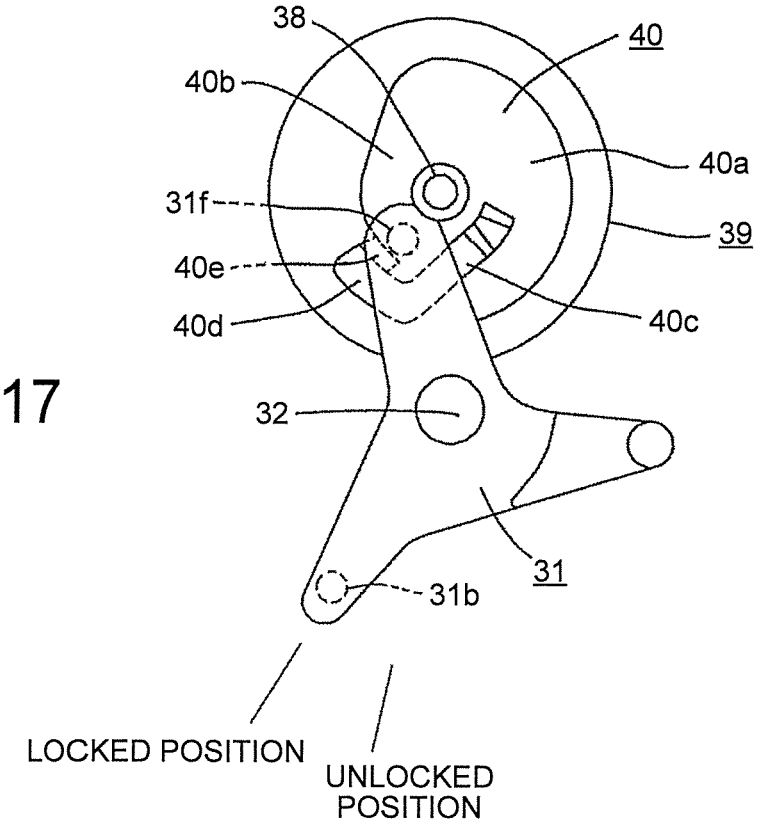
FIG. 17 is a front view illustrating the lock lever switched from the state in FIG. 16 to the locked position.

As illustrated in FIG. 16, even in the state switched to the unlocked state by the actuator 35, the locking operation by the door key cylinder 11C is effective. More specifically, when the lock link 33 is moved downward through the operation of the door key cylinder 11C to allow a lock rotation of the lock lever 31, the follower pin 31*f* can move from the terminating end side of the arc groove 40*d* toward the support shaft 38 through the communicative groove 40*e* as illustrated in FIG. 17, so that the lock lever 31 smoothly switches to the locked position.

As described later, the actuator 35 can rotate the cam wheel 39 clockwise from the state in FIG. 7 and FIG. 15. The clockwise rotation of the cam wheel 39 is transmitted to the latch mechanism 15 to set the door in the door-opening enabled state. Here, it is important that the clockwise rotation of the cam wheel 39, that is, the door-opening rotation keeps the follower pin 31*f* proximate to the support shaft 38 and holds the lock lever 31 in the locked position. Supposing that the lock lever 31 is in the unlocked position, when the cam wheel 39 makes a door-opening rotation, the follower pin 31*f* comes into abutment with the outer periphery of the narrow-range flat groove 40*b* to return toward the support shaft 38, so that the lock lever 31 switches to the locked position.

Figure 18:
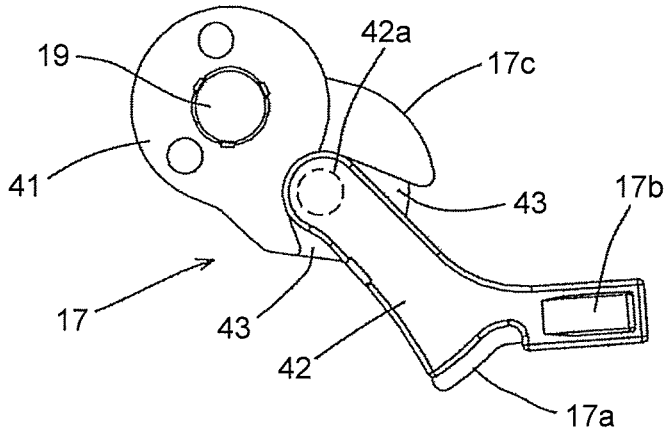
FIG. 18 is a rear view of the ratchet of the latch unit.
Figure 19:
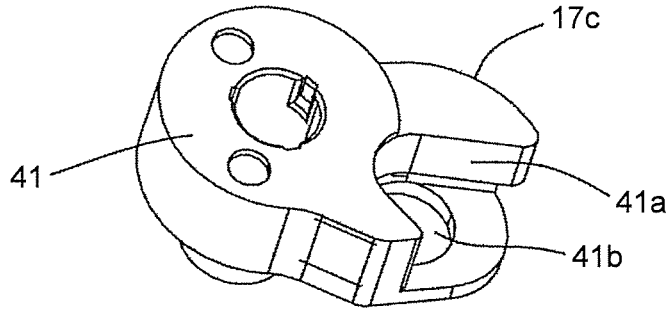
FIG. 19 is a perspective view of a base lever of the ratchet.
Figure 20:
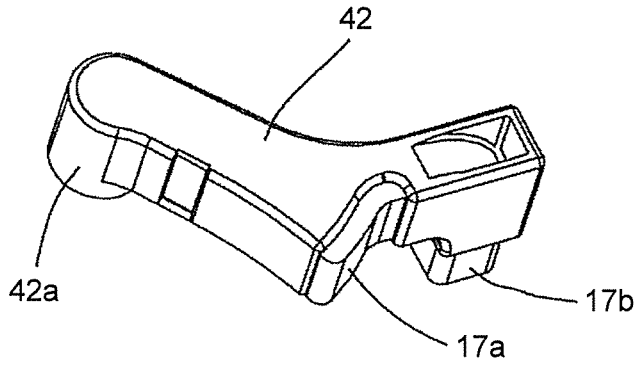
FIG. 20 is a perspective view of a pawl lever of the ratchet.
Figure 21:
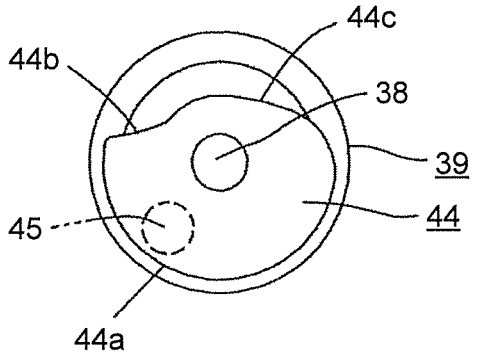
FIG. 21 is a rear view of the ratchet retainer.

Unlike the known one, the ratchet 17 in the present embodiment is divided into a base lever 41 and a pawl lever 42 as illustrated in FIGS. 18 to 20. The base lever 41 and the pawl lever 42 are preferably an insertion-molded product of a metal plate and a resin cover.

The base portion of the base lever 41 is secured to the ratchet shaft 19. The tip end side of the base lever 41 has a bifurcated portion 41*a*, and a shaft hole 41*b* is formed at the base portion of the bifurcated portion 41*a*. A joint shaft 42*a* secured to the shaft hole 41*b* is provided at the base portion of the pawl lever 42. The joint shaft 42*a* is secured to the shaft hole 41*b* so that the base portion of the pawl lever 42 faces the inside of the bifurcated portion 41*a* of the base lever 41. The pawl 17*a* is formed at the metal plate of the pawl lever 42.

Gaps 43 are formed between the base side of the pawl lever 42 and the bifurcated portion 41*a*. The gaps 43 enable the pawl lever 42 to singly rotate about the joint shaft 42*a* relative to the base lever 41 by a predetermined angle.

Preferably, the ratchet spring 22 is provided between the base lever 41 and the pawl lever 42. The elastic force of the ratchet spring 22 biases the pawl 17*a* of the pawl lever 42 in a direction in which it is engaged with the latch 16.

Figure 5:
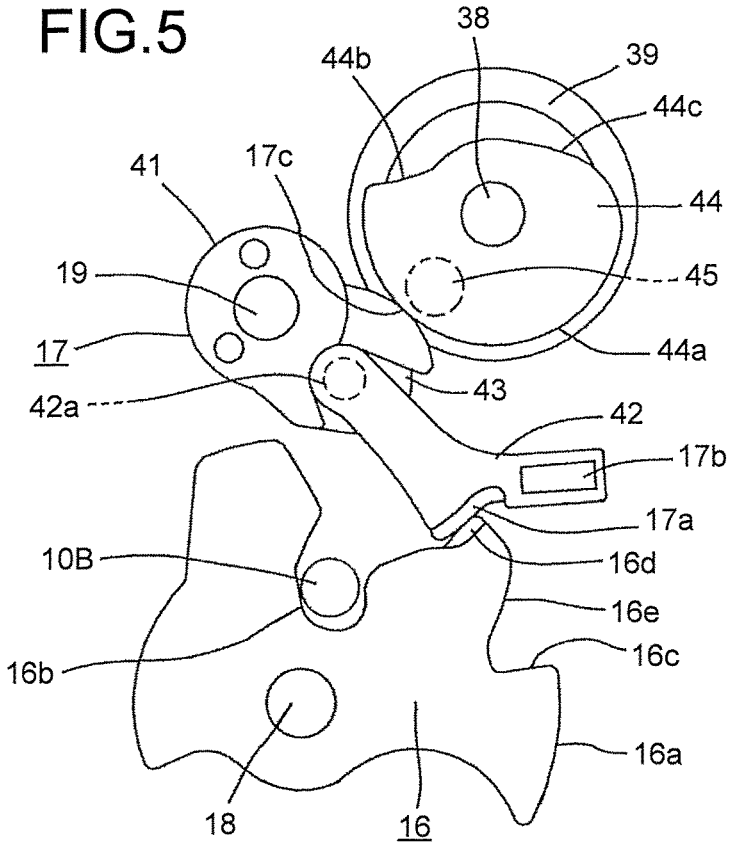
FIG. 5 is a rear view illustrating the latch mechanism in a full latch state and the ratchet retainer in the reference position.

In the door-closed state in FIG. 3 and FIG. 5, a latch return force that returns the latch 16 in the unlatch direction acts on the latch 16. The latch return force is transmitted from the full latch engagement portion 16*d* of the latch 16 to the ratchet 17 through the pawl 17*a*.

The ratchet 17 in the present disclosure is configured to receive the latch return force from the latch 16 so that a release component force is produced in the ratchet 17. Briefly speaking, the release component force is a component of force that pushes out the joint portion (joint shaft 42*a*) between the base lever 41 and the pawl lever 42 in a direction away from the latch 16. If the joint shaft 42*a* is pushed out in a latch disengaging direction, the ratchet 17 is buckled and therefore the ratchet 17 alone is unable to keep the latch 16 in the full latch position against the latch return force.

The ratchet that is disengaged from the latch only by the latch return force is defined as "release component force-disengaging ratchet" in the present disclosure. The release component force-disengaging ratchet may be configured with a one-piece ratchet, as disclosed in Japanese Laid-open Patent Publication No. 2015-074976.

In the vicinity of the side of the ratchet 17, a ratchet retainer 44 is disposed, which can block displacement of the ratchet 17 in the latch disengaging direction. The ratchet retainer 44 is rotatably secured by the support shaft 38.

Figure 22:
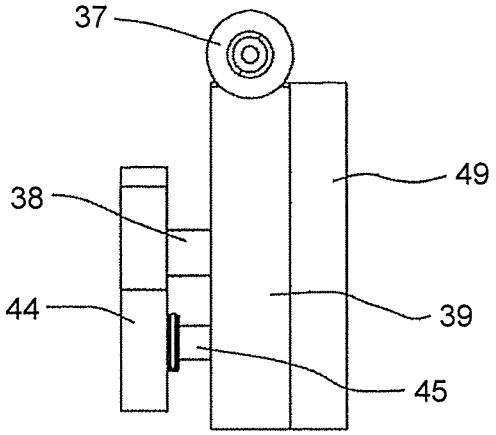
FIG. 22 is a side view of a cylindrical worm, the cam wheel, and the ratchet retainer.

The ratchet retainer 44 is disposed so as to overlap the cam wheel 39 in the front-back direction, and the cam wheel 39 and the ratchet retainer 44 are joined to each other by a joint pin 45. As illustrated in FIG. 22, the cylindrical worm 37 of the actuator 35 is meshed with a gear groove formed on the outer periphery of the cam wheel 39. When the actuator 35 is actuated to rotate the cam wheel 39, the ratchet retainer 44 also rotates through the joint pin 45.

A block surface 44*a*, a release surface 44*b*, and a return cam surface 44*c* are formed on the outer periphery of the ratchet retainer 44. The ratchet 17 (base lever 41) has an abutment wall 17*c* that can confront the block surface 44*a*, the release surface 44*b*, and the return cam surface 44*c*.

The block surface 44*a* is an arc surface around the support shaft 38 and has a length of about half a circle. In a blocked state in which the abutment wall 17*c* confronts the block surface 44*a*, even when a release component force in the latch disengaging direction is produced in the ratchet 17 by the latch return force from the latch 16, the release component force is received by the block surface 44*a*, and the abutment wall 17*c* (joint shaft 42*a*) is unable to move in the latch disengaging direction. In the blocked state, therefore, the engaged state between the ratchet 17 and the latch 16 is kept, and the door-closed state in FIG. 3 and FIG. 5 is kept.

The position where the block surface 44*a* can abut on the abutment wall 17*c* is the block position of the ratchet retainer 44. Since the block surface 44*a* has a length of about half a circle, the block position of the ratchet retainer 44 also extends in a wide range. This is to prevent release of the block surface 44*a* and the abutment wall 17*c* confronting each other when the cam wheel 39 rotates counterclockwise in FIG. 15 (rotates clockwise in FIG. 5) from the reference position when the actuator 35 allows the lock lever 31 to switch to the unlocked position.

Figure 4:
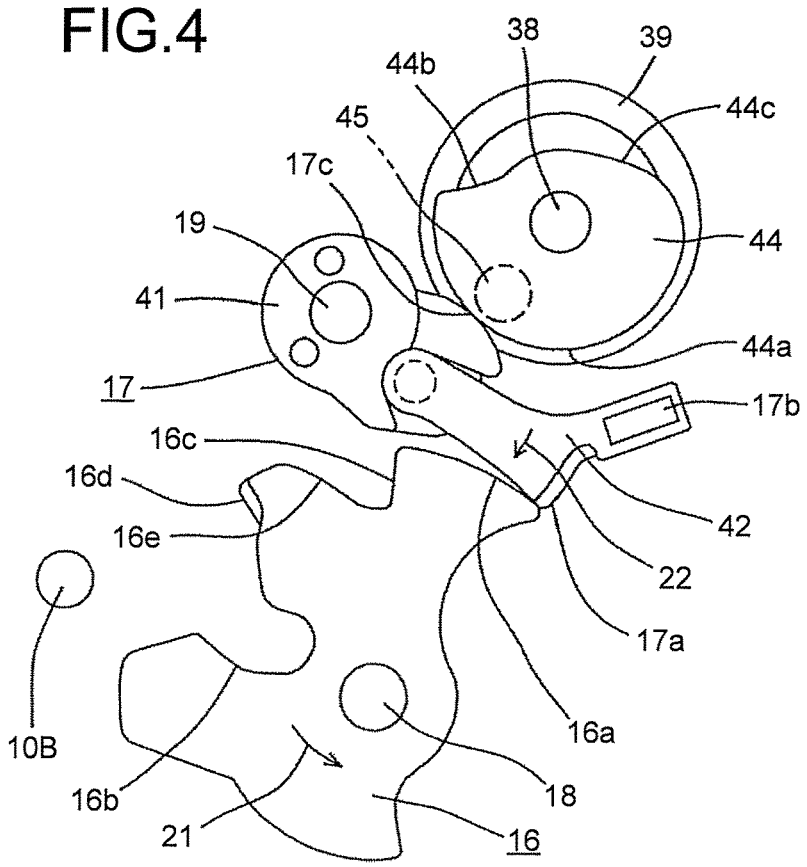
FIG. 4 is a rear view illustrating a latch mechanism in an unlatch state and a ratchet retainer in a reference position.

The reference position of the ratchet retainer 44 corresponding to the reference position of the cam wheel 39 (FIG. 7 and FIG. 15) is the position in FIG. 3, FIG. 4, and FIG. 5.

The door-opening rotation of the ratchet retainer 44 is counterclockwise in FIG. 5. The release surface 44*b* is continuous with the counterclockwise side of the block surface 44*a*. The release surface 44*b* is a cam surface with the radius relatively abruptly reduced from the support shaft 38.

Figure 6:
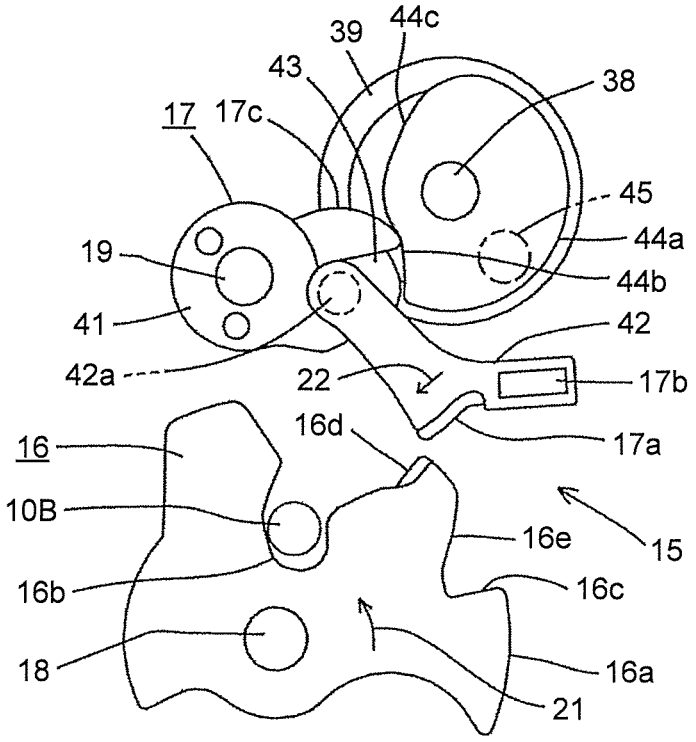
FIG. 6 is a rear view illustrating the ratchet disengaged from the latch by rotating the ratchet retainer from a block position to a release position.

When the ratchet retainer 44 rotates counterclockwise in FIG. 5, the abutment wall 17*c* is released from the block surface 44*a* to confront the release surface 44*b*. Then, as illustrated in FIG. 6, the ratchet 17 is bent by the release component force, and the pawl 17*a* is pushed out from the full latch engagement portion 16*d* (or the half latch engagement portion 16*c*) and displaced to the latch release position, whereby the restriction on the latch 16 is removed to enable door opening by the latch return force.

The position where the release surface 44*b* confronts the abutment wall 17*c* is the release position of the ratchet retainer 44. The position where the abutment wall 17*c* abuts on the block surface 44*a* is the functional position of the base lever 41. The position where the abutment wall 17*c* confronts the release surface 44*b* and the base lever 41 is pushed out by the release component force into the latch disengaging direction is the non-functional position of the base lever 41.

The return cam surface 44*c* is provided between the release surface 44*b* and the block surface 44*a* and formed with the radius increasing from the release surface 44*b* toward the block surface 44*a*. As the abutment wall 17*c* comes into abutment with the return cam surface 44*c*, the base lever 41, confronting the release surface 44*b* to move to the non-functional position, is gradually pushed in the latch engagement direction and returns to the functional position as illustrated in FIG. 5. The position where the return cam surface 44*c* confronts the abutment wall 17*c* is the push position of the ratchet retainer 44.

As described above, when the latch mechanism 15 is released to open the door, the ratchet retainer 44 rotates by 360 degrees. It is noted that the friction force produced between the base lever 41 and the ratchet retainer 44 is extremely small, and the rotational force necessary for the door-opening rotation of the ratchet retainer 44 is also small. This enables the use of a small motor with low output as the actuator 35.

In the present disclosure, the door can be opened by rotation in one direction of the single motor 36, and the lock mechanism 30 can be switched from the locked state to the unlocked state by rotation in the other direction. In addition, the lock mechanism 30 can be switched from the unlocked state to the locked state by rotation of the motor 36 in one direction. Furthermore, the switching between the locked state and the unlocked state of the lock mechanism 30 by the door key cylinder 11C can also be performed freely.

In this manner, since the actuation of the motor 36 and the actuation of the door key cylinder 11C do not interfere with each other, the design can be tailored to a variety of user needs.

When the door-closing operating force is weak to cause a half latch state in which the pawl 17*a* of the ratchet 17 is engaged with the half latch engagement portion 16*c* of the latch 16, the base lever 41 confronts the block surface 44*a* and is unable to rotate because the ratchet retainer 44 is in the reference position. In such a case, by pushing the door in the door-closing direction by hand, the latch 16 is pushed by the striker 10B and rotates toward the full latch position. Then, a joint slope 16*e* formed between the half latch engagement portion 16*c* and the full latch engagement portion 16*d* comes into abutment with the pawl lever 42 and allows the pawl lever 42 to rotate about the joint shaft 42*a* in the latch disengaging direction. At this point of time, the pawl lever 42 alone moves in the latch disengaging direction without rotating the base lever 41 through the gap 43, so that the latch mechanism 15 switches from the half latch state to the full latch state.

With the door-opening operation of the door-opening handle 11B, the ratchet pin 17*b* can be moved in the latch disengaging direction by the open link 25. In this case, it is necessary to unlock the lock lever 31.

The latch body 14 of the latch unit 10A has the striker advancing path 14*a* extending in the lateral direction approximately at the center in the up-down direction. With the striker advancing path 14*a* as a boundary, the latch 16 is disposed on the lower side of the latch body 14 and the ratchet 17 is disposed on the upper side of the latch body 14.

The ratchet shaft 19 of the ratchet 17 is disposed approximately at the center in the lateral direction in FIG. 3, and the support shaft 38 of the ratchet retainer 44 is disposed slightly above the ratchet shaft 19 to the right. In this configuration, the ratchet 17 and the ratchet retainer 44 can be disposed side by side in the lateral direction above the striker advancing path 14*a*. Consequently, a space 46 can be provided to the left of the ratchet shaft 19.

Figure 23:
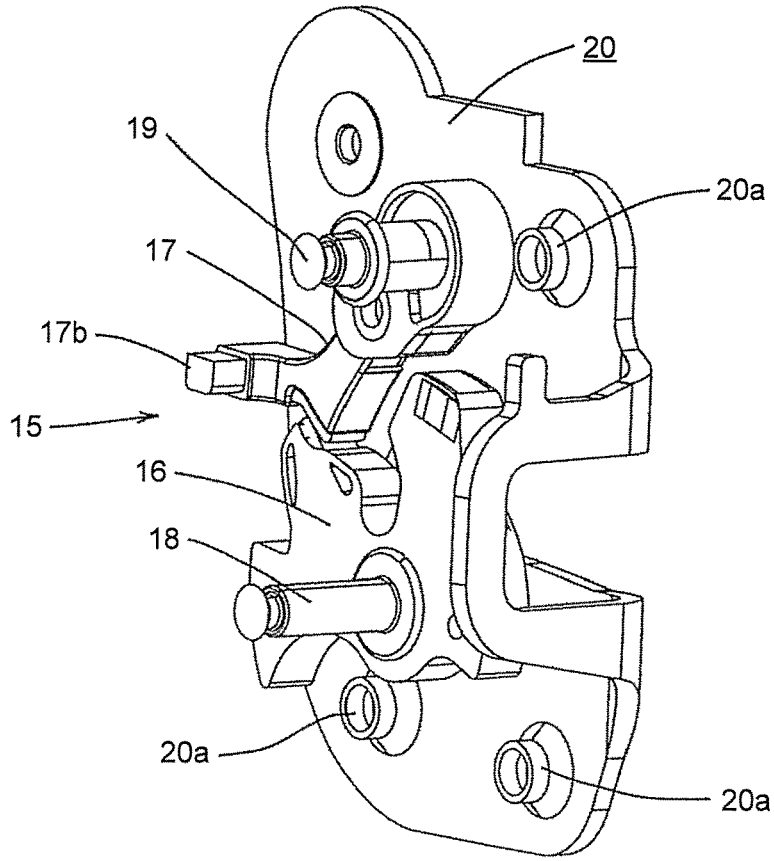
FIG. 23 is a front-side perspective view illustrating the height relation between bosses of a cover plate, the latch, and the ratchet.

On the front surface side of the cover plate 20, as illustrated in FIG. 23, a plurality of bosses 20*a* are provided, into which a plurality of countersunk bolts 13 used for fixing the door panel 11A are inserted. Each boss 20*a* protrudes toward the latch body 14 up to a position where it overlaps the rotation plane of the latch 16 or the ratchet 17. Thus, the bosses 20*a* need to be disposed at a position where they do not interfere with the rotational members such as the latch 16 and the ratchet 17.

In the present embodiment, three countersunk bolts 13 (bosses 20*a*) are provided to ensure sufficient attachment strength. Two of them are disposed below the striker advancing path 14*a* and in the vicinity of the latch 16 so as not to interfere with rotation of the latch 16. The remaining one faces the inside of the space 46 to the left of the ratchet shaft 19 above the striker advancing path 14*a*.

The improvement in arrangement relation of those parts enables the arrangement of the latch 16, the ratchet 17, the ratchet retainer 44, and three bosses 20*a* on the same plane and can significantly suppress the thickness in the front-back direction of the latch body 14.

Figure 24:
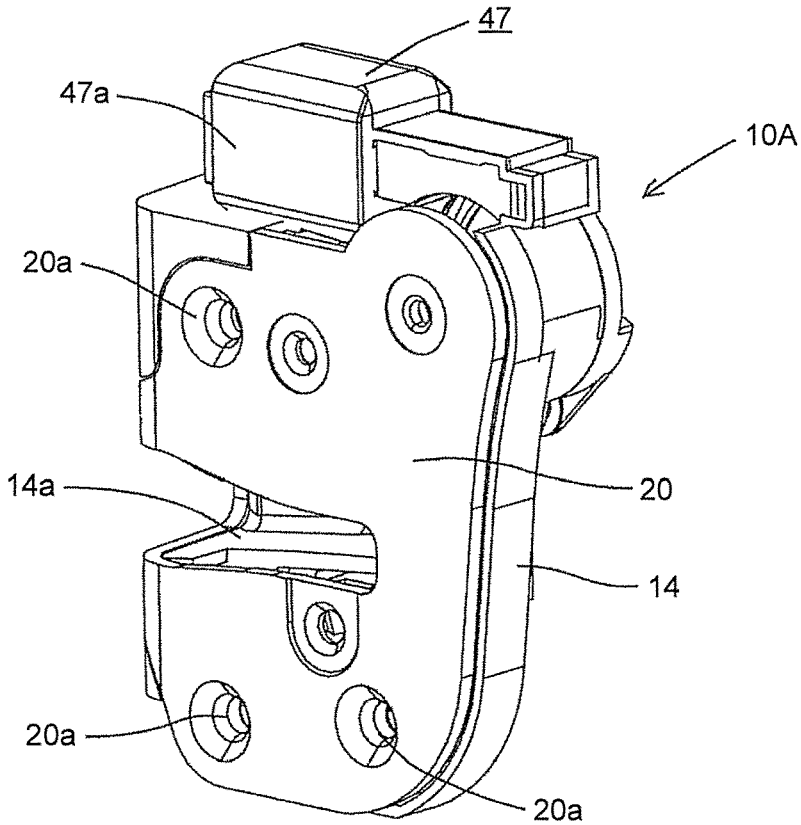
FIG. 24 is a rear-side perspective view illustrating a latch body and an actuator case.
Figure 25:
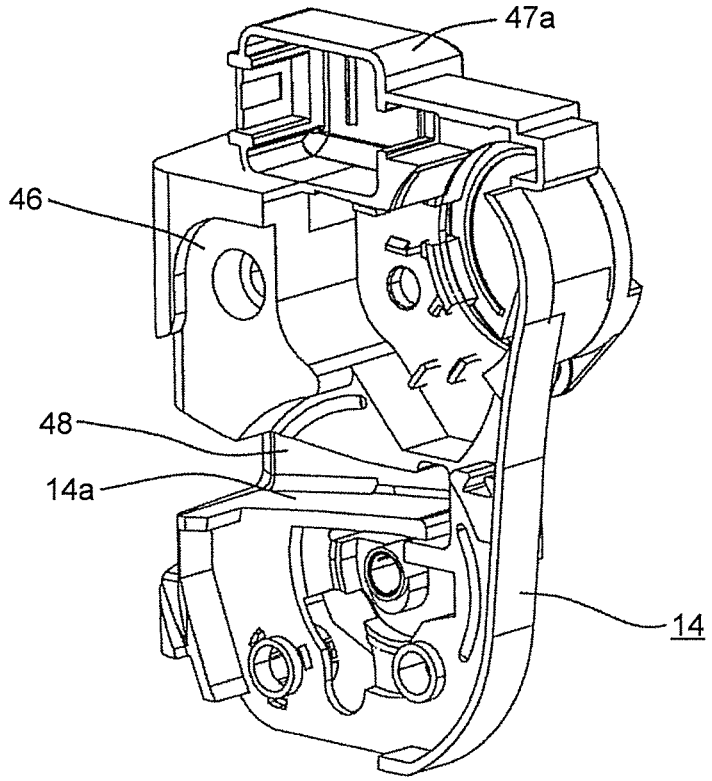
FIG. 25 is a rear-side perspective view of the latch body.
Figure 26:
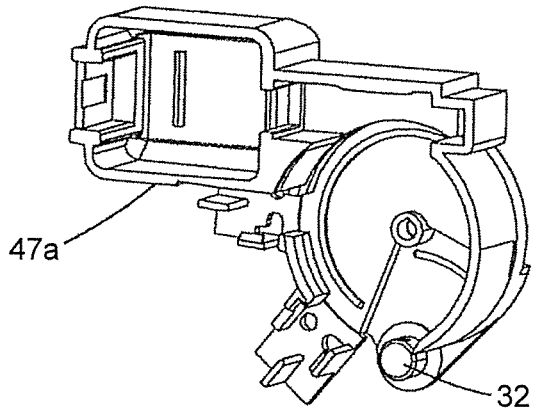
FIG. 26 is a rear-side perspective view of a main case of the actuator case.
Figure 27:
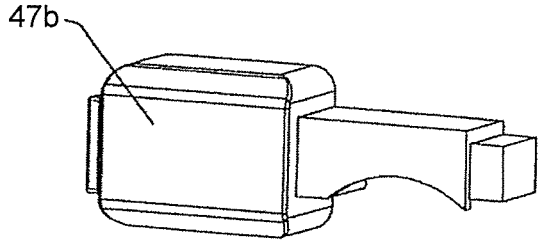
FIG. 27 is a rear-side perspective view of a sub case of the actuator case.

FIG. 24 is an external perspective view of the latch unit 10A, in which an actuator case 47 for the actuator 35 is attached on the top of the latch body 14. The motor 36 of the actuator 35 is disposed immediately above the latch body 14, and the shaft center of the motor shaft 36*a* and the cylindrical worm 37 is disposed in parallel with the striker advancing path 14*a*.

The latch body 14 is provided with a partition wall 48 extending forward for partitioning the striker advancing path 14*a*. As illustrated in FIG. 2, the front portion of the actuator case 47 is at the same position as a front end wall 48*a* of the partition wall 48 or on the back side of the front end wall 48*a* such that the front portion of the actuator case 47 does not protrude forward beyond the front end wall 48*a*. With this configuration, even when the actuator case 47 is disposed on the top of the latch body 14, the latch unit 10A can be attached in the attachment space 11E without interfering with the guide rail 11D.

Such a configuration can be achieved when the front-back case thickness Y of the actuator case 47 is significantly narrow relative to the latch body width Z in the front-back direction from the cover plate 20 to the front end wall 48*a* of the partition wall 48.

The ratchet retainer 44 and the cam wheel 39 overlap each other in the front-back direction and, in addition, the ratchet retainer 44 is disposed on the same plane as the ratchet 17, and the cam wheel 39 is disposed on the same plane as the cylindrical worm 37. This configuration also contributes to suppression of the front-back thickness of the actuator case 47.

When the ratchet 17 is a "release component force-disengaging ratchet" as in the present embodiment, the block on the ratchet 17 can be released by rotating the ratchet retainer 44 with an extremely small force. This enables the use of the small motor 36 and can also suppress the case thickness Y of the actuator case 47.

The actuator case 47 includes a main case 47*a* and a sub case 47*b* closing the back side of the main case 47*a*. The main case 47*a* has the lock shaft 32 securing the lock lever 31.

As illustrated in FIG. 7 and FIG. 12, an abutment rib 49 shaped like an arch extending over about half a circle is formed on the outer edge on the front surface side of the cam wheel 39. The latch body 14 is provided with a pair of a first switch 50 and a second switch 51. When the cam wheel 39 rotates, the first switch 50 and the second switch 51 come into abutment with the abutment rib 49 and switch on (or off).

As illustrated in FIG. 3, the latch body 14 is provided with an ajar switch 52 for detecting the rotational position of the latch 16. In the embodiment, two ajar switches 52 are used to individually detect the unlatch position, the half latch position, and the full latch position of the latch 16.

Figure 28:
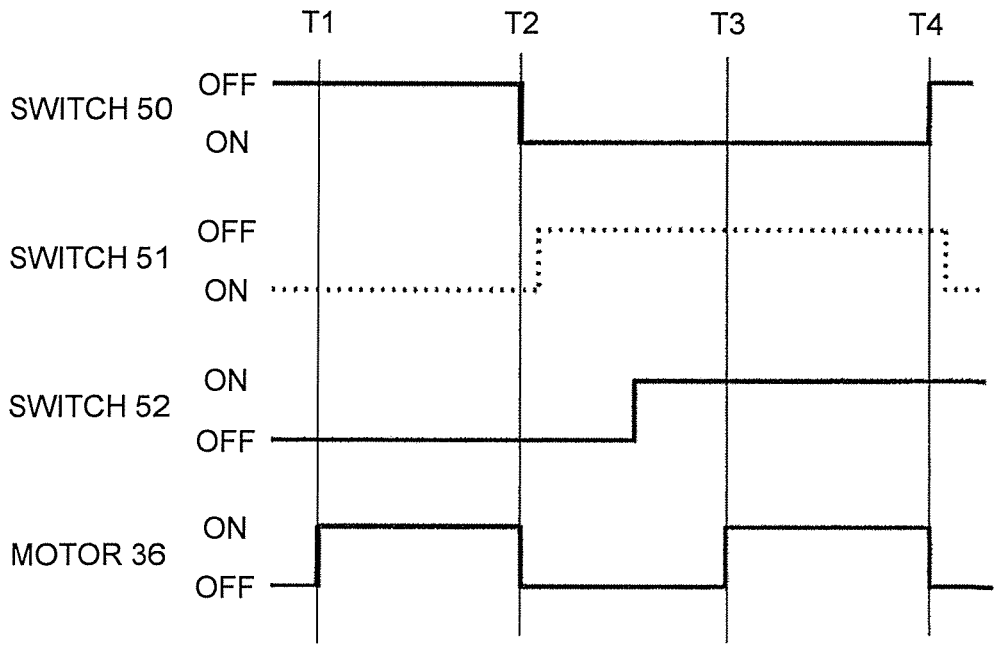
FIG. 28 is a time chart illustrating actuation of the actuator as power release means.

When the actuator 35 is actuated as power release means, the actuator 35 is actuated by a signal from the door or a door-opening operation switch of a remote controller (timing T1 in FIG. 28). When actuated as the power release means, the motor 36 makes a door-opening rotation, the cam wheel 39 rotates clockwise from the reference position in FIG. 7 and FIG. 15, and the ratchet retainer 44 integrated with the cam wheel 39 rotates counterclockwise from the reference position in FIG. 3 and FIG. 5.

The ratchet retainer 44 then shifts from the block position to the release position, the ratchet 17 is bent by the release component force, and the pawl 17*a* is pushed out from the full latch engagement portion 16*d* to enable the latch 16 to rotate by the latch return force in the unlatch direction.

After the latch 16 becomes able to rotate in the unlatch direction, at timing T2, the first switch 50 comes into abutment with the abutment rib 49 and turns on. At timing T2 when the first switch 50 turns on, the ratchet 17 is completely released from the blocked state by the ratchet retainer 44. If normal latch return force acts on the latch 16, it means that the door opening is completed.

However, even when the ratchet 17 releases the latch 16, the door sometimes does not open. For example, when the vehicle body is on a steep slope and strong gravity in the door-closing direction acts on the door, the latch 16 remains in the latch position in spite of the ratchet 17 released from the latch 16. In the case of a lift-up heavy door such as gate door, since strong gravity in the door-closing direction acts on the door, the latch 16 may remain in the latch position in spite of the ratchet 17 released from the latch 16. In such a circumstance, when returned to the latch engagement position, the ratchet 17 is engaged with the latch 16 again, that is, re-latched to keep the door-closed state.

For this, in the present embodiment, a re-latch suppressing program is built in a control unit of the actuator 35 to suppress re-latch.

At timing T2, when the first switch 50 turns on, the motor 36 which has been making a door-opening rotation is stopped. The ratchet retainer 44 is then kept in the release position.

When the door opening is not completed even after timing T2, the user may grab the door handle to open the door. At this point of time, since the ratchet retainer 44 is in the release position, the door is opened by the user's operation of pulling the door, except for an unexpected failure, and the latch 16 is returned to the unlatch position.

Such user's voluntary additional door-opening operation is usually performed within 600 milliseconds after the actuator 35 is actuated, and the door opening by the additional door-opening operation is recognized by the ajar switches 52 detecting the unlatch rotation of the latch 16.

In the present embodiment, after 200 milliseconds after the ajar switches 52 turn on, the motor 36 is allowed to make a door-opening rotation again. This is timing T3. This means that when the ajar switches 52 do not turn on, the motor 36 is stopped and the ratchet retainer 44 is kept in the release position.

At timing T3, the motor 36 resumes the door-opening rotation. Then at timing T4, the first switch 50 comes away from the abutment rib 49 and turns off again, and the motor 36 stops. At timing T4, the cam wheel 39 and the ratchet retainer 44 rotate by 360 degrees and return to the reference position.

This is the normal flow when the actuator 35 is used as power release means. The second switch 51 serves as a backup switch for the first switch 50 and is not used in the normal control.

The actuator 35 is actuated as power release means, the door-opening rotation of the motor 36 allows the ratchet retainer 44 to be displaced from the block position to the release position, and thereafter if a signal from the second switch 51 is input before a signal from the first switch 50 arrives, the first switch 50 is regarded as being failed. The second switch 51 is a normally closed switch and normally turns off with a slight delay after the first switch 50 turns on.

In this manner, when the second switch 51 turns off before the first switch 50 turns on, the control is performed with reference to the OFF of the second switch 51, and the motor 36 is stopped. Re-rotation of the motor 36 is the same as in normal control but the subsequent stopping of the motor 36 refers to the OFF of the second switch 51.

According the present disclosure, since the actuator case 47 may be continuous with the top of the latch body 14, the entire vehicle door latch device may be compact and may be easily attached in the attachment space between the door panel and the guide rail.

Moreover, since the actuator case 47 does not protrude in front of the latch body 14 when the actuator case 47 is disposed above the latch body 14, the vehicle door latch device may be easily attached in the attachment space between the door panel and the guide rail.

Moreover, since the motor shaft 36*a* and the cylindrical worm 37 extend along the striker advancing path 14*a*, the actuator 35 is arranged reasonably, and the front-back thickness of the actuator case 47 for the actuator 35 may be suppressed.

Moreover, the opening/closing of the door and the switching of the lock mechanism 30 may be performed by power of the motor 36.

Moreover, since the ratchet 17 is divided into the base lever 41 and the pawl lever 42, a configuration that enables the door-opening operation manually may be easily achieved.

Moreover, since the actuator case 47 may be continuous with the top of the latch body 14, the entire vehicle door latch device may be compact and may be easily attached in the attachment space between the door panel and the guide rail Moreover, since the actuator case 47 does not protrude in front of the latch body 14 when the actuator case 47 is disposed above the latch body 14, the vehicle door latch device may be easily attached in the attachment space between the door panel and the guide rail.

Moreover, the latch 16, the ratchet 17, and the ratchet retainer 44 may be arranged reasonably in a compact manner without interfering with a plurality of bosses 20*a* provided on the cover plate 20.

Moreover, since the actuator case 47 may be continuous with the top of the latch body 14, the entire vehicle door latch device may be compact and may be easily attached in the attachment space between the door panel and the guide rail.

Moreover, since the actuator case 47 does not protrude in front of the latch body 14 when the actuator case 47 is disposed above the latch body 14, the vehicle door latch device may be easily attached in the attachment space between the door panel and the guide rail.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A vehicle door latch device comprising:

a latch body having a rear side facing a rear of a vehicle, a front side opposite the rear side and facing a front of the vehicle, and a top side, the latch body including:

a latch secured by a latch shaft, the latch being disposed on the rear side of the latch body, the latch being configured to engage with a striker;

a ratchet secured by a ratchet shaft, the ratchet being disposed on the rear side of the latch body, the ratchet being configured to engage with the latch; and a striker advancing path into which the striker advances relatively;

a motor coupled to the ratchet to release the ratchet from the latch;

an actuator case provided on the top side of the latch body, the actuator case accommodating and entirely covering the motor;

a planar cover plate provided on the rear side of the latch body; and a partition wall provided on the front side of the latch body to form the striker advancing path, the partition wall including a front end wall, one side of the front end wall facing the planar cover and another side of the front end wall facing the front of the vehicle, wherein no part of the actuator case is located beyond the front end wall in a direction toward the front of the vehicle, wherein the motor has a motor shaft that has a cylindrical worm, the cylindrical worm having a shaft center parallel with the striker advancing path, wherein the latch body further comprises:

a ratchet retainer configured to block movement of the ratchet; and a cam wheel being meshed with the cylindrical worm and coupled to the ratchet retainer, wherein the motor is coupled to the ratchet via the motor shaft, the cylindrical worm, the cam wheel, and the ratchet retainer to release the ratchet from the latch, wherein the latch, the ratchet, and the ratchet retainer are arranged on a same plane, wherein the cam wheel and the ratchet retainer are secured commonly by a support shaft, wherein the latch shaft, the ratchet shaft, and the support shaft of the cam wheel and the ratchet retainer extend in a same direction as each other, wherein the ratchet includes a base lever secured to the ratchet shaft and a pawl lever with a pawl to engage the latch, wherein the pawl lever pivots about a joint shaft positioned between abutment walls on the base lever, and wherein rotation of the base lever by the ratchet retainer allows a respective abutment wall to move the joint shaft between engaging and disengaging the pawl with the latch.

2. The vehicle door latch device according to claim 1, further comprising:

a door-opening handle configured to release the latch by manual operating force; and a lock mechanism configured to switch between a locked state in which actuation of the door-opening handle is disabled and an unlocked state in which actuation of the door-opening handle is enabled, wherein the lock mechanism is configured to switch between the locked state and the unlocked state by power of the motor.

3. A vehicle door latch device comprising:

a latch body having a rear side facing a rear of a vehicle, a front side opposite the rear side and facing a front of the vehicle, and a top side, the latch body including:

a striker advancing path into which a striker advances relatively;

a latch secured to the latch body by a latch shaft at a position below the striker advancing path, the latch being configured to engage with the striker; and a ratchet secured to the latch body by a ratchet shaft at a position above the striker advancing path, the ratchet being configured to engage with the latch;

an actuator provided on the top side of the latch body, the actuator being configured to release the ratchet from the latch;

a partition wall provided on the front side of the latch body to form the striker advancing path, the partition wall including a front end wall, one side of the front end wall facing the rear of the vehicle and another side of the front end wall facing the front of the vehicle; and an actuator case entirely covering the actuator, wherein no part of the actuator case is located beyond the front end wall in a direction toward the front of the vehicle, wherein the actuator includes a motor having a motor shaft, the motor shaft having a cylindrical worm, the cylindrical worm having a shaft center parallel with the striker advancing path, wherein the latch body further comprises:

a ratchet retainer configured to block movement of the ratchet; and a cam wheel being meshed with the cylindrical worm and coupled to the ratchet retainer, wherein the motor is coupled to the ratchet via the motor shaft, the cylindrical worm, the cam wheel, and the ratchet retainer to release the ratchet from the latch, wherein the latch, the ratchet, and the ratchet retainer are arranged on a same plane, wherein the cam wheel and the ratchet retainer are secured commonly by a support shaft, wherein the latch shaft, the ratchet shaft, and the support shaft of the cam wheel and the ratchet retainer extend in a same direction as each other, wherein the ratchet includes a base lever secured to the ratchet shaft and a pawl lever with a pawl to engage the latch, wherein the pawl lever pivot about a joint shaft positioned between abutment walls on the base lever, and wherein rotation of the base lever by the ratchet retainer allows a respective abutment wall to move the joint shaft between engaging and disengaging the pawl with the latch.

4. A vehicle door latch device comprising:

a latch body having a rear side facing a rear of a vehicle, a front side opposite the rear side and facing a front of the vehicle, and a top side, the latch body including:

a striker advancing path into which a striker advances relatively;

a latch secured to the latch body by a latch shaft at a position below the striker advancing path, the latch being configured to engage with the striker;

a release component force-disengaging ratchet secured at a lateral center of the latch body by a ratchet shaft at a position above the striker advancing path, the ratchet being configured to engage with the latch; and a ratchet retainer secured by a support shaft at a position above the striker advancing path and at the latch body on a side in an advancing direction of the striker, the ratchet retainer being configured to block movement of the ratchet in a latch disengaging direction by a release component force of the ratchet;

a cover plate provided on the rear side of the latch body, the cover plate including bosses into which countersunk bolts used for fixing the vehicle door latch device to a door panel are inserted, where one of the bosses faces a space in the latch body formed on an opposite side to the support shaft with the ratchet shaft interposed therebetween an actuator provided on the top side of the latch body, the actuator being configured to rotate the ratchet retainer to disengage the ratchet from the latch;

a partition wall provided on the front side of the latch body to form the striker advancing path, the partition wall including a front end wall, one side of the front end wall facing the rear of the vehicle and another side of the front end wall facing the front of the vehicle; and an actuator case entirely covering the actuator, wherein no part of the actuator case is located beyond the front end wall in a direction toward the front of the vehicle, wherein the actuator includes a motor having a motor shaft, the motor shaft having a cylindrical worm, the cylindrical worm having a shaft center parallel with the striker advancing path, wherein the latch body further comprises a cam wheel being meshed with the cylindrical worm and coupled to the ratchet retainer, wherein the motor is coupled to the ratchet via the motor shaft, the cylindrical worm, the cam wheel, and the ratchet retainer to release the ratchet from the latch, wherein the latch, the ratchet, and the ratchet retainer are arranged on a same plane, wherein the cam wheel are secured by the support shaft of the ratchet retainer, wherein the latch shaft, the ratchet shaft, and the support shaft of the cam wheel and the ratchet retainer extend in a same direction as each other, wherein the ratchet includes a base lever secured to the ratchet shaft and a pawl lever with a pawl to engage the latch, wherein the pawl lever pivot about a joint shaft positioned between abutment walls on the base lever, and wherein rotation of the base lever by the ratchet retainer allows a respective abutment wall to move the joint shaft between engaging and disengaging the pawl with the latch.

* * * * *